US006463746B1

(12) United States Patent
Bethuy et al.

(10) Patent No.: US 6,463,746 B1
(45) Date of Patent: Oct. 15, 2002

(54) ICE PRODUCING MACHINE AND METHOD WITH GEAR MOTOR MONITORING

(75) Inventors: Tim Bethuy, New Fairfield, CT (US); Randy Brian Palm, Barnwell, SC (US)

(73) Assignee: Scotsman Ice Systems, Vernon Hills, IL (US)

( * ) Notice: Subject to any disclaimer, the term of this patent is extended or adjusted under 35 U.S.C. 154(b) by 0 days.

(21) Appl. No.: 09/671,385

(22) Filed: Sep. 27, 2000

(51) Int. Cl.[7] ..... F25C 1/14
(52) U.S. Cl. ..... 62/66; 62/137; 62/354
(58) Field of Search ..... 62/136, 354, 137, 62/66; 73/293; 340/619

(56) References Cited

U.S. PATENT DOCUMENTS 3,650,121 A * 3/1972 Kimpel et al. ..... 62/136
3,698,203 A * 10/1972 Stoelting ..... 318/475
3,988,902 A * 11/1976 Jacobs ..... 62/136
4,383,417 A * 5/1983 Martineau ..... 62/127
4,822,996 A * 4/1989 Lind ..... 250/222.1
5,615,559 A * 4/1997 Kress et al. ..... 62/136
6,050,097 A * 4/2000 Nelson et al. ..... 62/137

* cited by examiner

*Primary Examiner*—William E. Tapolcai
(74) *Attorney, Agent, or Firm*—Ohlandt, Greeley, Ruggiero & Perle, L.L.P.

(57) ABSTRACT

An ice producing machine that has a cylindrical evaporator, a compressor that circulates refrigerant supplied to the evaporator, an auger that removes ice from the evaporator and an ice bin for holding the ice. Potential damage to the machine that might result from abnormal loading of the motor that drive the auger is prevented by monitoring the motor current and turning off the motor and compressor before abnormal loading can cause damage. False ice bin not full interpretations are avoided by setting the threshold of a light detector that senses whether the ice bin is full or not full to slightly less than the voltage developed by the light detector when subjected to ambient light only.

25 Claims, 5 Drawing Sheets

ICE PRODUCING MACHINE AND METHOD WITH GEAR MOTOR MONITORING

FIELD OF THE INVENTION

This invention relates to an ice producing machine and a method that produces ice.

DESCRIPTION OF THE PRIOR ART

An ice producing machine generally has a condensing unit and an ice making assembly that operate together to produce and harvest ice. Ice making assemblies operate either in a batch mode or a continuous mode. In the batch mode, operation alternates between freeze and harvest cycles. In the continuous mode, operation constantly makes and harvests ice simultaneously. Continuous mode ice producing machines that make flaked or nugget ice forms are commonly known as flaker ice producing machines.

The ice making assembly of a flaker ice producing machine generally includes a cylindrical evaporator that has an external surface surrounded by tubes through which a refrigerant flows. The refrigerant is circulated by operation of a compressor. As the cylindrical evaporator is being chilled, water is applied to its internal surface so that ice forms thereon. A layer of the ice is removed and conveyed to a top of the evaporator by an auger. The ice is then pushed through a head that defines the ice form and dispensed to an ice bin.

The auger drive train includes an electric motor and a gear reducer. The motor has typically included a centrifugal switch that closes when the motor attains normal operating speed. Closure of the centrifugal switch actuates a relay that turns the compressor on to circulate the refrigerant. The centrifugal switch remains closed and the relay remains actuated until the motor stops rotating. When the motor does stop rotating, the centrifugal switch opens, the compressor relay is deactuated and the compressor is turned off.

The motor stops rotating when it is turned off intentionally, when there is a power failure or when motor loading becomes so great as to prevent rotation. Motor loading can be caused by a number of circumstances including motor or gear reducer failure, bearing failure or ice clogging in the evaporator due to over chilling. Generally, motor loading due to any of these circumstances will occur over a considerable amount of time before it becomes so great as to stop rotation. During this time, the ice producing machine may be extensively damaged. For example, continued operation of the compressor during heavy motor loading can cause evaporator mounting bolts to break, the cylinder to rotate and the refrigerant tubes to break or leak, thereby releasing the refrigerant.

The ice making assembly of a flaker ice producing machine also includes an ice bin into which the ice is conveyed and stored. A light detector is positioned to detect and provide a bin full signal voltage when the ice bin is full. The ice making assembly responds to the ice bin full voltage to stop making ice until the light detector provides a voltage that represents a bin not full condition. One prior art method of setting a threshold for the light detector calculated the threshold at 50% of the voltage developed by the light detector with only ambient light incident thereon. During ice making, the software interprets voltage above the threshold as the bin being full and voltage below the threshold as the bin being not full. For a bin not full condition, the emitter beam is fully incident on the light detector and the light detector voltage tends toward zero volt. However, during ice making, water drops can form on the light detector window and provide a degree of obscurity that can provide false readings. That is, the light detector develops voltages above the threshold when the bin is not full. These readings re interpreted by the software as the bin being full.

There is a need for an ice producing machine and method that turns off the compressor and ice making operation thereof before motor loading can result in damage to the machine or the need for service calls.

There is also a need for an improved light detector threshold setting technique that is not subject to faulty interpretation by the system software.

SUMMARY OF THE INVENTION

The present invention satisfies the aforementioned need with an ice producing machine and method that monitors current flow through the motor that drives the auger and turns off the motor and the compressor when a parameter proportional to the current flow exceeds a threshold that signifies a potential load problem. The method uses a three strike process by which the motor that drives the auger is subsequently turned on after a short wait. If the current flow parameter still exceeds the threshold, the motor is turned off a second time and then on again after a short wait. If the current flow parameter still exceeds the threshold, the motor is turned off a third time and the ice producing machine enters a wait status. If the current flow parameter is below the threshold, the three strike process is reset and the ice producing machine is free to perform normal ice making operations. Each time the motor is turned off an alert is signaled. If the motor is turned off a third time, the alert will remain on to alert the operator/owner that service is required.

The present invention also provides a threshold setting procedure for a light detector that detects ice bin full conditions. This procedure responds to an ambient light voltage produced by the light detector to set the threshold level of the detector to either of two levels dependent on the value of the ambient light voltage. If the ambient light voltage is less than a first value, the threshold is set to a fraction of the ambient voltage. If the ambient light voltage is equal to or greater than the first value, the threshold is set to the ambient voltage minus a fractional amount. For example, the first value may be about one volt, the fraction may be 0.75 and the fractional amount may be about 0.5 volt. In either case, the threshold is set near the ambient level, which results in higher thresholds than the prior art method, thereby avoiding the water drop obscurity problem.

BRIEF DESCRIPTION OF THE DRAWING

Other and further objects, advantages and features of the present invention will be understood by reference to the following specification in conjunction with the accompanying drawings, in which like reference characters denote like elements of structure and.

DESCRIPTION OF THE INVENTION

Figure 1:
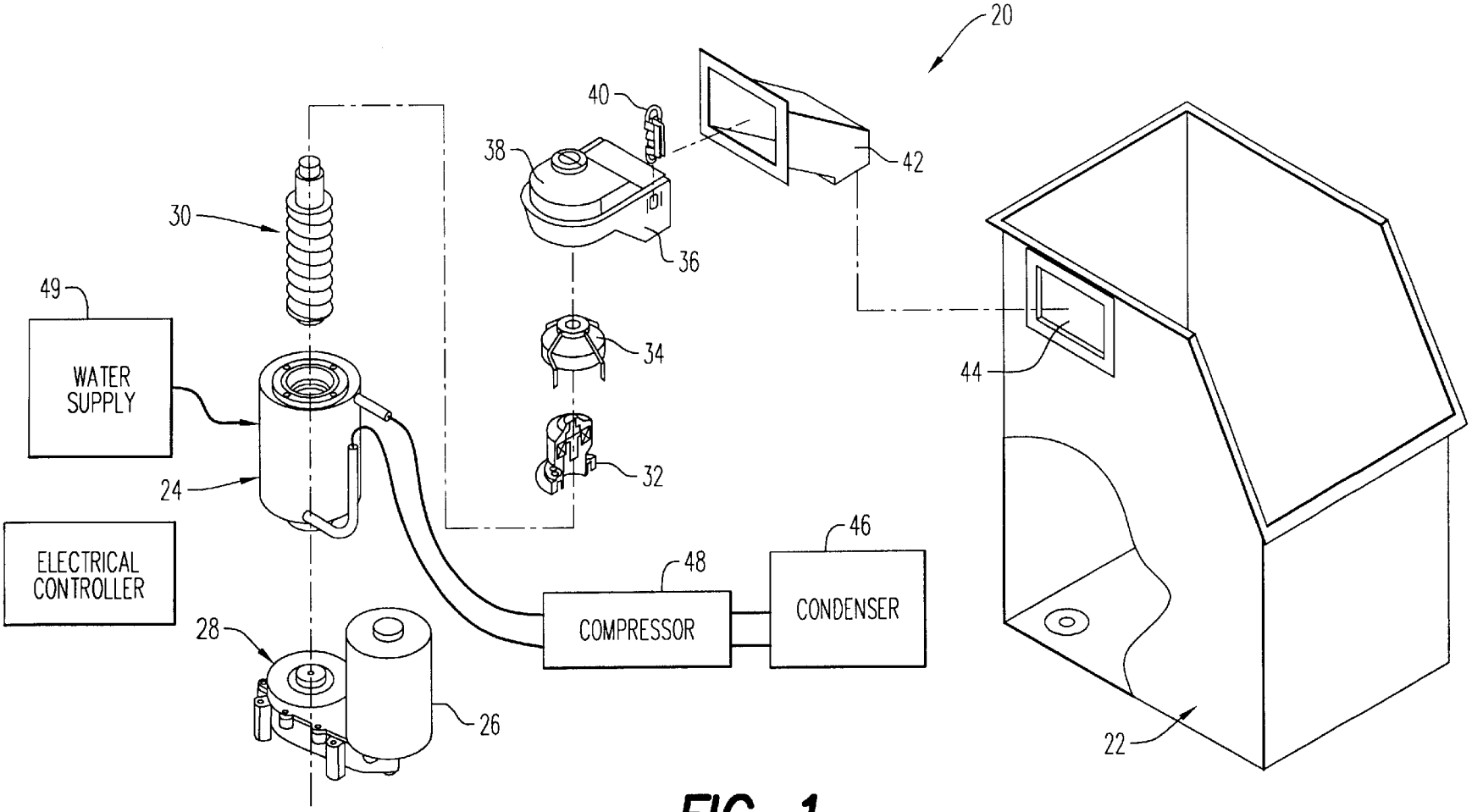
FIG. 1 is a perspective view of the ice making machine of the present invention.

Referring to FIG. 1, an ice producing machine 20 includes an ice bin 22, an evaporator 24, a gear motor 26, a gear reducer 28, an auger 30, a breaker head 32, an ice sweep 34, an ice chute 36, an ice chute cover 38, ice bin light detector 40 and an ice chute extender 42, all of which fit together as shown by the dot dash line. Ice bin 22 has an ice chute hole 44, in which ice chute extender 42 fits. Ice producing machine 20 also includes a condenser 46 and a compressor 48 that are connected in a refrigerant circuit with evaporator 24 and a water supply 49 that provides water to the interior of cylindrical evaporator 24. An electrical controller 50 controls ice producing machine 20 to operate to make and harvest ice. Optionally, ice producing machine 20 may not have an ice bin 22.

Figure 2:
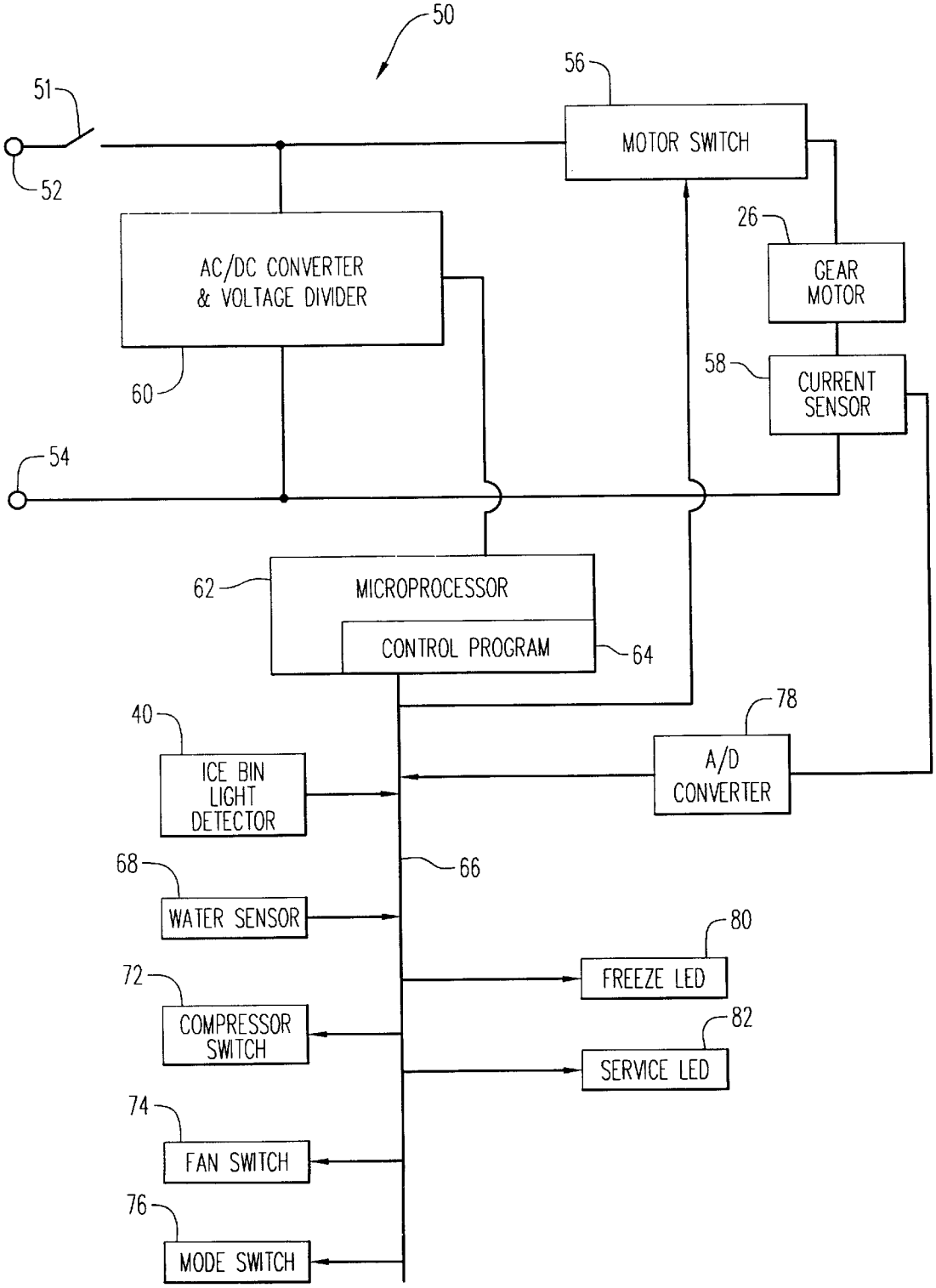
FIG. 2 is a block diagram, in part, and a schematic circuit diagram, in part, of the electrical control for the FIG. 1 ice making machine.

Referring to FIG. 2, electrical controller 50 includes a power on/off switch 51, a microprocessor 62, a gear motor switch 56, a current sensor 58 and an ac/dc converter and voltage divider 60. A pair of connectors 52 and 54 make connection to an ac power main, for example, 110 or 220 volts, 60 or 50 Hz. Connectors 52 and 54 are connected in an electrical circuit with gear motor 26, power on/off switch 51, microprocessor 62, gear motor switch 56, current sensor 58 and AC/DC converter and voltage divider 60. AC/DC converter and voltage divider 60 converts the ac power line voltage to a dc operating voltage that is applied to microprocessor 62.

Microprocessor 62 includes a control program 64 and a bus 66. Bus 66 is connected with ice bin light detector 40, a water sensor 68, a compressor switch 72, a fan switch 74, a mode switch 76, an a/d converter 78, motor switch 56, a freeze LED 80 and a service LED 82. Control program 64 controls microprocessor 62 to communicate with these devices interconnected with bus 66 to operate ice producing machine 20 in ice making operations.

Water sensor 68 is associated with water supply 49 (FIG. 1). Compressor switch 72 is operable to turn compressor 48 (FIG. 1) on and off. Fan switch 74 is operable to turn condenser 46 (FIG. 1) on and off. Mode switch 76 is operable to set a freeze mode and a standby mode for ice producing machine 20. The a/d converter 78 converts the output of current sensor 58 to a parameter, such as a digital voltage, that is usable by microprocessor 62. Current sensor 58 is operable to monitor the current flow through gear motor 26. Current sensor 58 may be any suitable current sensing device. For example, current sensor 58 may be a toroid in which the motor lead is threaded through its center and a voltage proportional thereto is developed in another winding on the toroid by transformer action.

Figure 3:
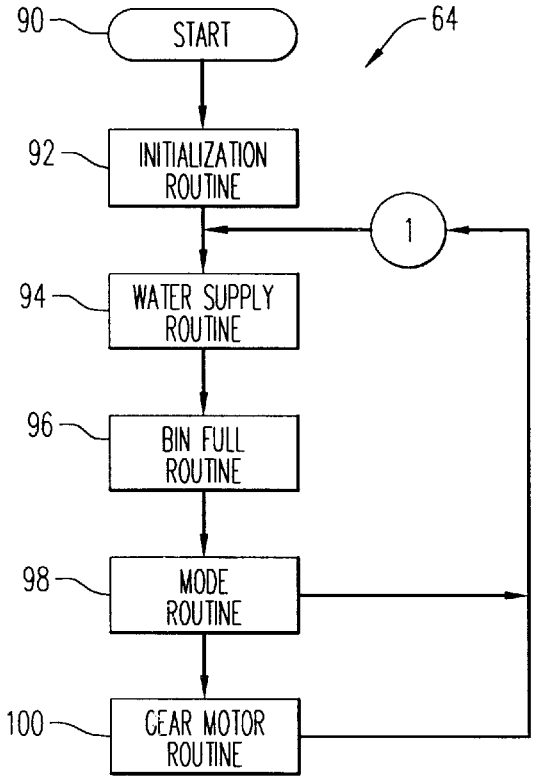
FIG. 3 is an over all flow diagram of the control program for the microprocessor of the FIG. 2 circuit.

Referring to FIG. 3, control program 64 begins when power on switch 51 is closed at start step 90. Control program 64 next performs an initialization routine 92 that sets various thresholds and other parameters used by control program 64. Control program 64 next performs a water supply routine 94 to determine the availability of water. Control program 64 next performs an ice bin full routine 96. Control program 64 next performs a mode routine 98. If in a run mode, compressor 48, condenser 46 and gear motor 26 are turned on to begin making ice. If not in a run mode, control is returned to water supply routine 94. Control program 64 then performs a gear motor routine 100.

Figure 4:
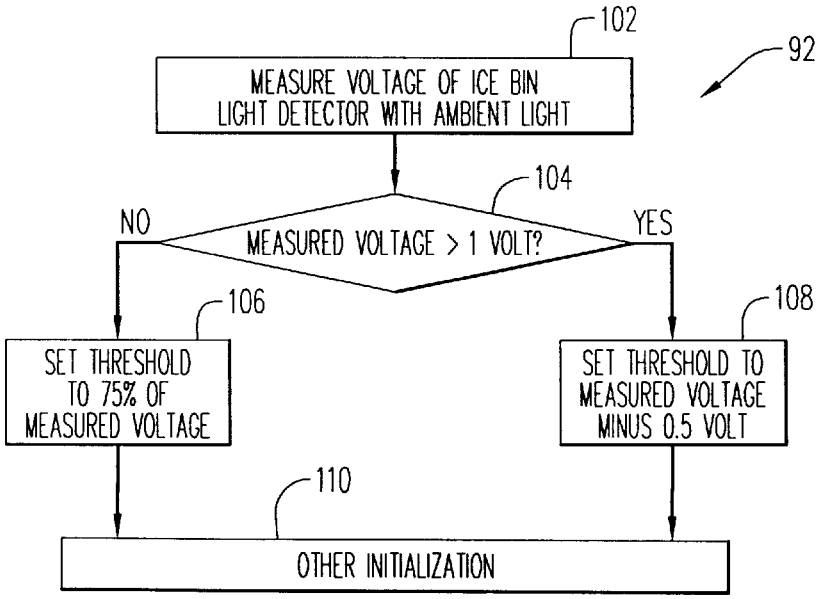
FIG. 4 is a flow diagram of the initialization routine of the FIG. 3 control program.

Referring to FIG. 4, initialization routine 92 includes a step 102 that measures voltage of ice bin light detector 40 with ambient light only. Step 104 determines if the measured voltage is greater than a predetermined value, which is determined by the design of light detector 40. The predetermined value is preferably in the range of about 0.75 volt to about 5 volts. The predetermined value is shown as one volt, by way of example. If not greater, step 106 sets the threshold of light detector 40 to a fraction of the measured voltage. The fraction is preferably in a range of about 0.6 or 60% to about 0.85 or 85%. For this example, the fraction is about 0.75 or 75%. If greater, step 108 sets the threshold to the measured voltage minus a predetermined amount. The predetermined amount is in a range of about 0.25 volt to about 0.75 volt. For this example, the predetermined amount is about 0.5 volt. Step 110 performs other initializations. This procedure sets the light detector threshold nearer to ambient than the prior art technique of setting the threshold at 50% of ambient. This provides a greater margin for water drop obscurity voltage readings, thereby preventing such readings from exceeding the threshold when the bin is not full.

Figure 5:
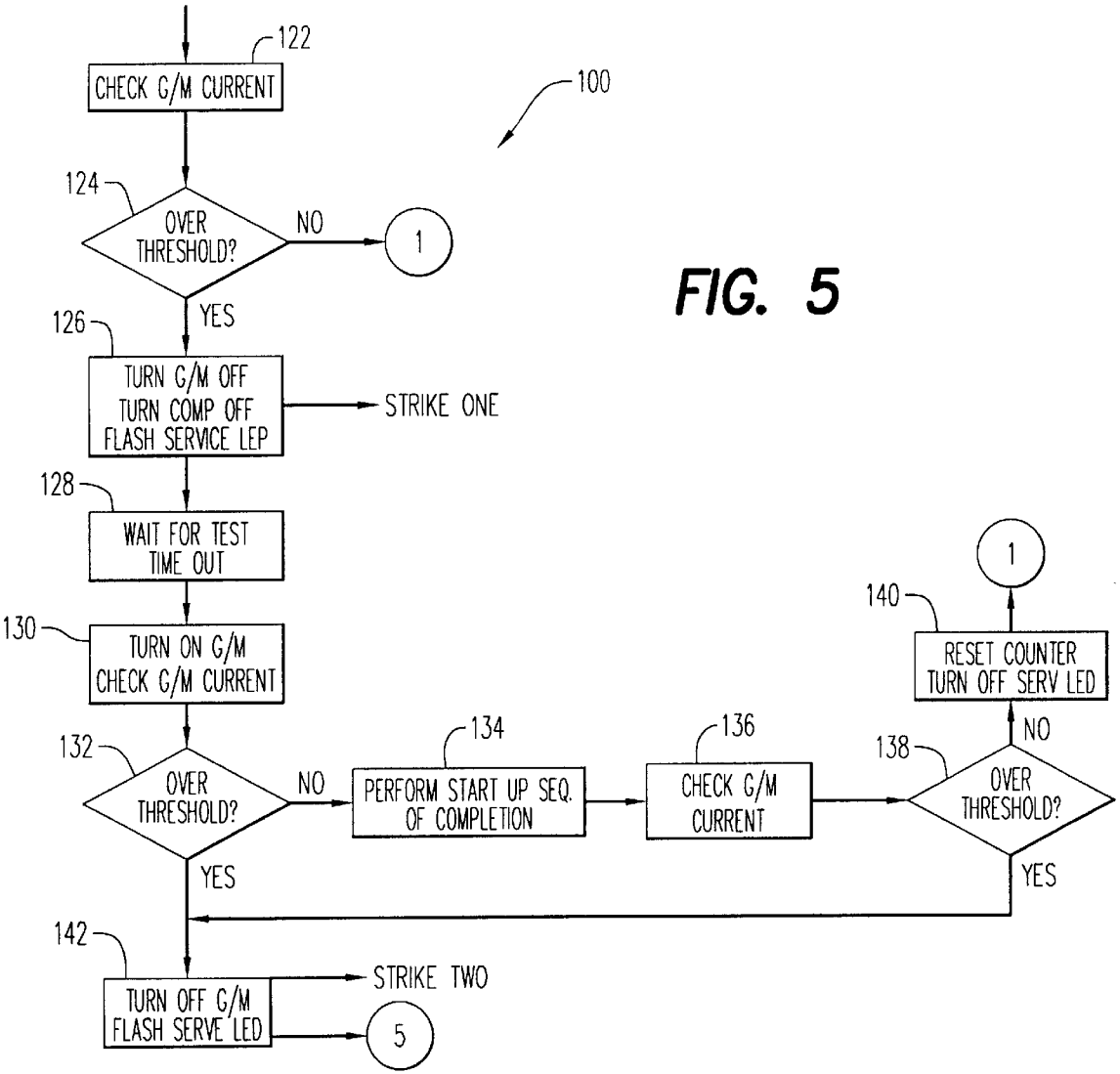
FIGS. 5 and 6 are flow diagrams of the gear motor routine of the FIG. 3 control program.

Referring to FIG. 5, gear motor routine 100 begins with step 122 that checks the gear motor current. Step 124 then determines if a parameter proportional to the gear motor current is over the threshold. The parameter, for example, is the output voltage of a/d converter 78. If not, control is returned to step 92 (FIG. 3). If the gear motor current parameter is more than the threshold, step 126 (with reference to FIG. 2) turns off gear motor 26 (opens motor switch 56), turns off compressor 48 (opens compressor switch 72) and flashes the service LED 82. This is the first strike of a three strike and you're out process conducted by gear motor routine 100. A strike count is incremented at this time. Step 128 times out a wait interval before step 130 turns on gear motor 26 and checks the gear motor current. If the gear motor current parameter is not over the threshold, step 134 performs a start up sequence in which compressor 48 is turned on. Step 136 checks the gear motor current. Step 138 then determines if the gear motor current parameter is over the threshold. If not, the strike count is reset, service LED 82 is turned off and control passes to water supply routine 94 (FIG. 3).

Figure 6:
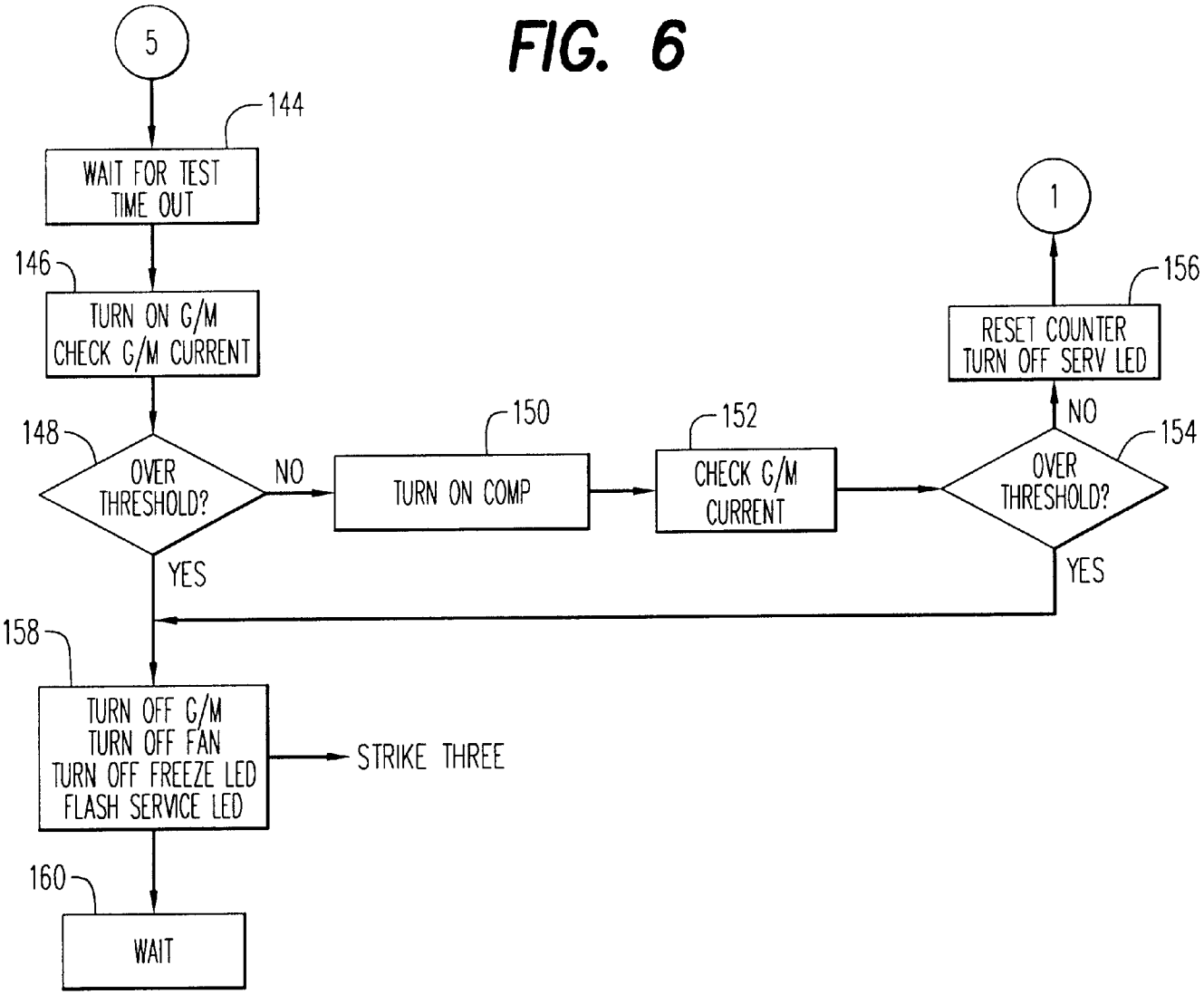

If either step 132 or step 138 determine that the gear motor current exceeds the threshold, step 142 turns off the gear motor, flashes service LED 82 and increments the strike count to two. Referring to FIG. 6, step 144 times out a short wait interval before step 146 turns on the gear motor and checks the gear motor current. Step 148 then determines if the gear motor current parameter is over the threshold. If not, step 150 turns on the compressor. Step 152 checks the gear motor current. Step 154 then determines if the gear motor current parameter exceeds the threshold. If not, step 156 resets the strike count, turns off service LED 82 and passes control to water supply routine 94 (FIG. 3).

If either step 148 or step 154 determines that the gear motor current parameter exceeds the threshold, step 158 increments the strike count to three, turns off gear motor 26, the condenser fan, freeze LED 80 and flashes service LED 82. Step 160 then causes control program 64 to enter a wait status. The flashing service LED 82 alerts an operator/owner that ice producing machine needs service.

Thus, the ice producing machine and method of the present invention detects abnormal loading of the gear motor and turns off the gear motor and the compressor before catastrophic events occur that can cause extensive damage.

The present invention having been thus described with particular reference to the preferred forms thereof, it will be obvious that various changes and modifications may be made therein without departing from the spirit and scope of the present invention as defined in the appended claims.

What is claimed is:

1. A method of controlling an ice producing machine that has a compressor, an evaporator, an auger that removes ice from the evaporator and a motor that drives the auger, said method comprising:

(a) providing a parameter proportional to current flow through said motor;

(b) if said parameter exceeds a predetermined threshold, turning said motor off;

(c) if said parameter exceeds said predetermined threshold, turning said compressor off;

(d) if said parameter is below said predetermined threshold, performing normal ice making operations; and (e) subsequent to step (b) and after a predetermined time, turning said motor on; and (f) repeating steps (a), (b) and (e) until either step (d) is performed or step (e) is performed a predetermined number of times without step (d) being performed.

2. The method of claim 1, wherein said predetermined number is two or more.

3. The method of claim 1, wherein said predetermined number is three.

4. The method of claim 1, wherein step (b) also signals an alert.

5. An ice producing machine that has a compressor, an evaporator, an auger that removes ice from said evaporator and a motor that drives said auger, said machine comprising:

a microprocessor for controlling said evaporator, said compressor, said auger and said motor to perform an ice making operation;

first means for performing a first operation that provides a parameter proportional to current flow through said motor;

second means for performing a second operation that, if said parameter exceeds a predetermined threshold, turns said motor off;

third means for performing a third operation that, if said parameter exceeds said predetermined threshold, turns said compressor off;

fourth means for performing a fourth operation that, if said parameter is below said predetermined threshold, performs said ice making operation; and fifth means for performing a fifth operation that a predetermined time after the second operation is performed turns said motor on; and wherein said first, second and fifth means repeat said first, second and fifth operations, respectively, until either said fourth means performs said fourth operation or said fifth means performs said fifth operation a predetermined number of times without said fourth means performing said fourth operation.

6. The ice producing machine of claim 5, wherein said predetermined number is two or more.

7. The ice producing machine of claim 6, wherein said predetermined number is three.

8. The ice producing machine of claim 5, wherein said second means also signals an alert.

9. A method of controlling an ice producing machine that has a compressor, an evaporator, an auger that removes ice from said evaporator, a motor that drives said auger and an ice bin, said method comprising:

(a) providing a parameter proportional to current flow through said motor;

(b) if said parameter exceeds a predetermined threshold, turning said motor off;

(c) if said parameter exceeds said predetermined threshold, turning said compressor off;

(d) if said parameter is below said predetermined threshold, performing a normal ice making operation, and wherein said normal ice making operation includes the steps of:

(d1) providing an ambient light voltage proportional to ambient light incident on a light detector that detects whether said ice bin is full of ice; and (d2) setting a threshold for said light detector that is greater than 50% of said ambient light voltage.

10. The method of claim 9, further comprising: (e) subsequent to step (b) and after a predetermined time, turning said motor on; and (f) repeating steps (a), (b) and (e) until either step (d) is performed or step (e) is performed a predetermined number of times without step (d) being performed.

11. The method of claim 10, wherein said predetermined number is two or more.

12. The method of claim 9, wherein step (b) also signals an alert.

13. The method of claim 9, wherein step (d2) establishes said threshold for said light detector at a first level that is a fraction of said ambient light voltage if said ambient light voltage is below a predetermined value and at a second level that is said ambient light voltage minus a fractional amount if said ambient light voltage is above said predetermined value.

14. The method of claim 13, wherein said predetermined number is three, and wherein said fraction is in the range of about 60% to about 85%, said predetermined value is in a range of about 0.75 volt to about 5 volts and said predetermined fractional amount is in the range of about 0.25 volt to about 0.75 volt.

15. An ice producing machine that has a compressor, an evaporator, an auger that removes ice from said evaporator and a motor that drives said auger, said machine comprising:

a microprocessor for controlling said evaporator, said compressor, said auger and said motor to perform an ice making operation;

light detecting means that provides an ambient light voltage proportional to ambient light in said ice bin;

first means for performing a first operation that provides a parameter proportional to current flow through said motor;

second means for performing a second operation that, if said parameter exceeds a predetermined threshold, turns said motor off;

third means for performing a third second operation that, if said parameter exceeds a predetermined threshold, turns said compressor off;

fourth means for performing a fourth operation that, if said parameter is below said predetermined threshold, performs said ice making operation; and wherein said fourth means includes a threshold setting means that responds to said ambient light voltage to establish a threshold for said light detecting means that is greater than 50% of said ambient light voltage.

16. The ice producing machine of claim 15, further comprising:

fifth means for performing a fifth operation that a predetermined time after the second operation is performed turns said motor on; and wherein said first, second and fifth means repeat said first, second and fifth operations, respectively, until either said fourth means performs said fourth operation or said fifth means performs said fifth operation a predetermined number of times without said fourth means performing said fourth operation.

17. The ice producing machine of claim 16, wherein said predetermined number is two or more.

18. The ice producing machine of claim 17, wherein said second means also signals an alert.

19. The ice producing machine of claim 16, wherein said fourth procedure establishes said threshold at a first level that is a fraction of said ambient light voltage if said ambient light voltage is below a predetermined value and at a second level that is said ambient light voltage minus a fractional amount if said ambient light voltage is above said predetermined value.

20. The ice producing machine of claim 19, wherein said predetermined number is three, and wherein said fraction is in a range of about 60% to about 80%, said predetermined value is in a range of about 0.75 volt to about 5 volts and said predetermined fractional amount is in a range of about 0.25 volt to about 0.75 volt.

21. A method of controlling an ice producing machine that has an ice making assembly, an ice bin and a light detector for said ice bin that detects whether the ice bin is full or not full of ice, aid method comprising:

(a) providing an ambient light voltage proportional to ambient light incident on said light detector; and (b) setting a threshold for said light detector that is greater than 50% of said ambient light voltage.

22. The method of claim 21, wherein step (b) sets said threshold at a value that is slightly less than said ambient light voltage.

23. The method of claim 22, wherein said threshold voltage is about in a range of about 60% to about 85% of said ambient light voltage.

24. The method of claim 22, wherein said threshold voltage is less than said ambient light voltage by a fractional amount in a range of about 0.25 volt to about 0.75 volt.

25. The method of claim 22, wherein step (b) establishes said threshold for said light detector at a first level that is a fraction of said ambient light voltage if said ambient light voltage is below a predetermined value and at a second level that is said ambient light voltage minus a fractional amount if said ambient light voltage is above said predetermined value.

* * * * *